US005806894A

United States Patent [19]

Dottel

[11] Patent Number: 5,806,894

[45] Date of Patent: Sep. 15, 1998

[54] DOCUMENT COVERING OR PROTECTIVE DEVICE

[75] Inventor: Jean-Marc Dottel, Valenciennes, France

[73] Assignee: Achat et Distribution d'Articles de Classement "A D Classement", Valenciennes, France

[21] Appl. No.: 810,684

[22] Filed: Feb. 28, 1997

[51] Int. Cl.[6] ..... B42D 1/00

[52] U.S. Cl. ..... 281/38; 402/79; 281/19.1

[58] Field of Search ..... 402/79; 281/38, 281/15.1, 21.1, 19.1, 51, 45

[56] References Cited

U.S. PATENT DOCUMENTS

| | | | |
|---|---|---|---|
| D. 275,576 | 9/1984 | Kirk | 402/79 X |
| 1,495,953 | 5/1924 | Dick | 402/79 X |
| 3,528,602 | 9/1970 | Ritchie | 402/79 X |
| 4,402,585 | 9/1983 | Gardlund | 402/79 X |
| 4,925,720 | 5/1990 | Hansen | 402/79 X |
| 5,335,027 | 8/1994 | Lin et al. | 402/79 X |

*Primary Examiner*—Willmon Fridie, Jr.
*Attorney, Agent, or Firm*—Harrison & Egbert

[57] ABSTRACT

A document covering or protective device which is formed by at least one quadrangular pocket made of a flexible plastic or a similar material. This quadrangular pocket has at least a first opening on one of its sides. The pocket further includes a second adjacent, partial opening on one of the sides adjacent to the first opening. The first opening is uppermost and the second opening is provided laterally on a right or on a left of the pocket. The pocket has laterally, in the region of one of its sides, a perforated strip designed for the binding together of several such devices.

8 Claims, 1 Drawing Sheet

DOCUMENT COVERING OR PROTECTIVE DEVICE

FIELD

The invention relates to a document covering or protecting device, as well as to a process for manufacturing such a device.

It will find an application, in particular, in the field of office accessory manufacture and, more generally speaking, in those cases in which it is necessary to protect a document such as a sheet of paper or other item.

BACKGROUND ART

In this field, there are known document protecting devices formed by a quadrangular pocket or sleeve of flexible plastic or a similar material, closed on three sides and having an opening, generally an upper one via, which to insert the document. On one of the lateral sides, the device generally has a perforated strip to facilitate its filing.

Such a device, although efficient in terms of protection, nonetheless has the drawback of making it difficult to insert the document, the latter needing, in particular, to possess a certain degree of rigidity to be able to be inserted completely.

To facilitate the insertion, one thus has recourse to various manual expedients, which can, however, cause the document to become damaged. Another solution is to make the pocket considerably larger than the document to prevent it from rubbing laterally when inserted.

There is known another document protecting device which tends to overcome the aforementioned drawbacks and which takes the form of a quadrangular pocket of flexible plastic or a similar material, closed on two adjacent sides and open on the other two.

While insertion is facilitated in such devices, the drawback then concerns the retention of the document, since it can more easily escape from the device since the latter is open on two sides.

One of the objects of the present invention is to provide a document protecting device that makes it possible to overcome the aforementioned drawbacks and which combines the advantages of each of the known devices, namely ease of insertion of the document and proper retention of the document, once inserted.

Another object of the present invention is to provide a document protecting device that offers good resistance to wear and tear and, in particular, to tearing, as well as a process for manufacturing such a device that is easy to implement.

Another object of the present invention is to provide a process for manufacturing a document protecting device that can easily be adapted to current production machines, which means that there is no effect upon the cost of the finished product.

Further objects and advantages of the present invention will emerge in the course of the following description which is, however, given only by way of illustration, and is not intended to limit same.

SUMMARY OF THE INVENTION

According to the invention, the document protecting device, constituted by at least one quadrangular pocket of flexible plastic or a similar material, having at least a first opening on one of the sides, is characterized by the fact that the pocket further comprises a second, partial, adjacent opening on one of the sides adjacent to the first opening.

This being said, according to the process for manufacturing a device according to the invention, there is formed a continuous sleeve of a flexible plastic or similar material, which is folded down flat on itself to form two opposite lateral sides of the quadrangular pocket, the continuous sleeve is cut and welded transversely to form, respectively, the said first opening and the closed opposite fourth side, the process being characterised by the fact that the sleeve is formed from a sheet folded back on itself and the free edges of which are partially welded together, the said second opening being formed in the region of the said free edges by the non welded area.

BRIEF DESCRIPTION OF THE INVENTION

The present invention will be more readily understood in the light of the following description, accompanied by the annexed drawings, which form an integral part thereof, wherein.

Figure 9:
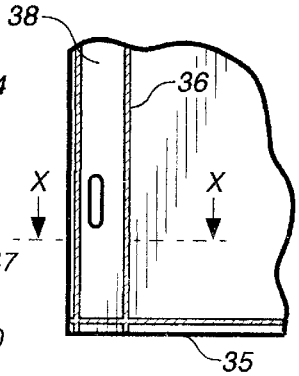
FIG. 9 is a detail view of the alternative embodiment of the device according to FIG. 6, on the binding side.
Figure 10A:
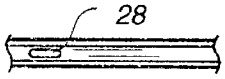

FIGS. 10*a* and *b* are cross-sectional views along line X—X of FIG. 9, before and after welding respectively.

DETAILED DESCRIPTION OF THE INVENTION

The invention relates to a document protecting device as well as to a process for manufacturing such a device.

As shown by the different variants illustrated in the figures, the document protecting device 1; 11; 21; 31; 41 is at least constituted by a pocket 2; 12; 22; 32; 42 formed, in particular, of flexible plastic or a similar material, and which is usually quadrangular.

In each of the respective variants, the pocket has at least one opening 3; 13; 23; 33; 43 on one of the sides of the pocket, and which, in the case of the figures, forms an upper opening.

According to the present invention, pocket 2; 12; 22; 32; 42 further comprises a second, adjacent, partial opening 4, 14; 24; 34; 44, on one of the sides adjacent to the said first opening 3; 13; 23; 33; 43.

On the other hand, the other sides, 5, 6; 15, 16; 25, 26; 35, 36, 45, 46 are closed.

Thus, as shown in the respective figures, each device or, more precisely, each pocket of each device, can be open over a large extent, as in the case of pockets with corner openings, for instance right-handed or left-handed, as the case may be.

However, on one of the sides, for instance in the region of the second opening 4; 14; 24; 34; 44, passage is restricted, owing to a segment 7; 17; 27; 37; 47 which is designed to be closed and which possibly terminates the side.

The non open area, 7, 17; 27; 37; 47 has, in particular, a weld resulting, for example from the method used to obtain the pocket from a sheet folded back on itself.

By way of example, for a document protecting device having a format approaching the standard format of 21×29.7 mm, the said second partial opening is provided over the long side, with the closed portion having a dimension of, for example, between 3 and 15 cm.

However, instead of providing for the said first opening on the upper side, on one hand, and second opening laterally, on the other hand, either on the right or on the left of the pocket, the opposite could be contemplated.

Figure 1:
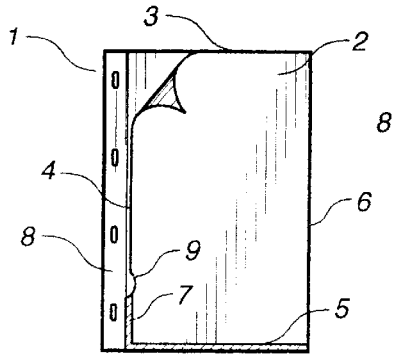
FIG. 1 is a schematic front view of a first form of embodiment of the document protecting device according to the invention.
Figure 6:
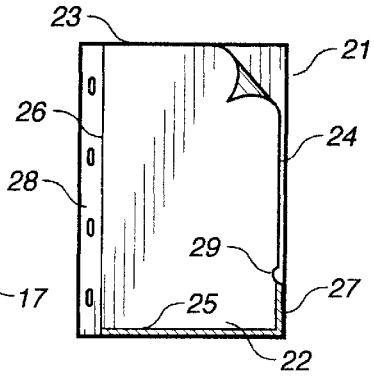
FIG. 6 shows a first alternative embodiment of the device illustrated in FIG. 4.

This being said, in certain forms of embodiment, such as those represented in FIGS. 1 and 6, pocket 2; 22 has laterally, in the region of one of its sides, a perforated strip 8; 28 designed to facilitate the binding of several devices 1; 21.

In other forms of embodiment, the document protecting device can have a plurality of pockets gathered together on at least one of their lateral sides, in order to form an exercise book type binding.

This being, when the pocket has, as mentioned earlier, a weld in the region of the said non open area 7; 17; 27; 37; 47, it is preferable to be able to avoid stressing the said weld when opening.

Indeed, when the flap defined by the first and second openings 3, 4; 13, 14, 23, 24; 33, 34; 43, 44 is manipulated by the user, he or she pulls on the said weld and is liable to damage it. 10 To avoid this phenomenon, the second, partial adjacent opening 4; 24; 34; 44 can be terminated by a slot 9; 29; 39; 49 to prevent tearing of the non open area 7; 27; 37; 47 of the side of the corresponding pocket.

Figure 7:
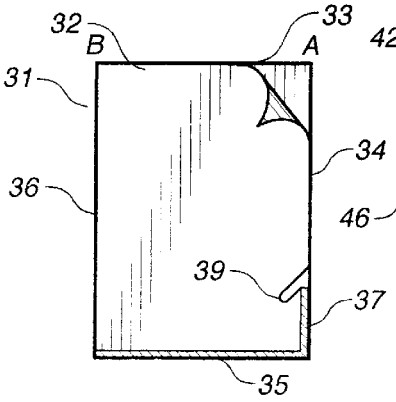
FIG. 7 shows a second alternative embodiment of the device illustrated in FIG. 4.
Figure 8:
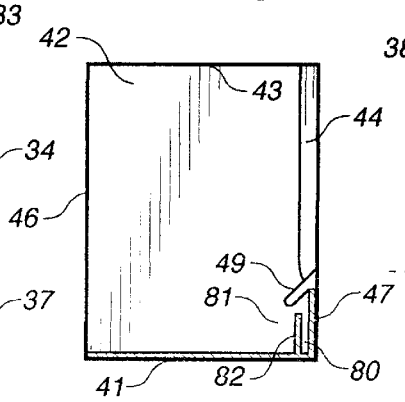
FIG. 8 shows a third alternative embodiment of the device illustrated in FIG. 4.

As shown in FIGS. 7 and 8, the slots 39; 49 are, for example, of a longitudinal shape. If we call A the apex of pocket common to the first 33, 43 and to the second 34; 44 openings, B the apex of the pocket common to the first opening 33; 43 and to the side 36; 46 opposite the second opening 34, 44, and C the point forming the limit between the second opening 34, 44 and the non open area 37, 34, we note that the slot 39; 49 is orientated, advantageously, parallel to the median relative to the side BC of triangle ABC.

Figure 4:
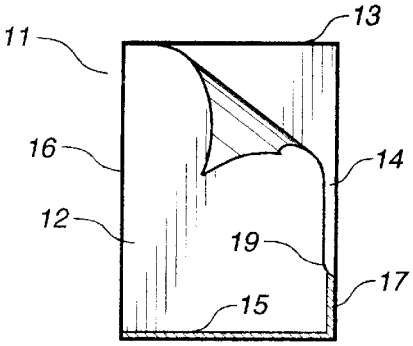
FIG. 4 shows a second form of embodiment of a document protecting device according to the invention.

According to another measure, these anti-tearing means are formed, as shown, for example, by the form of embodiment of FIG. 4, by a cut away portion 19 making it possible to avoid localized stress in the area of the junction between opening 14 and the non open area respectively designated by the number 17. Such a cut away portion, possibly placed elsewhere, can also facilitate the opening of the pocket.

In the event of the so-called non open area 47, for example in FIG. 8, overlapping in relation to partial open area 44, in order to avoid any unwanted protrusion of the documents to be protected, there can be provided means 81 for complementarily retaining the documents, in the area of the lower portion of the pocket, ahead of non open area 47.

By way of example, these means 81 can be formed by a partial weld area 82 as shown in FIG. 8, provided substantially in the prolongation of partial open area 44. In this case, the documents are restrained in the lower portion, and opening 44 is further reinforced by slot 49, or other means, interconnecting the open area 44 and the non open area 47, preventing localization of the stress on the weld upon opening the pocket.

The space 80 remaining free between the partial weld 82 and the non open area 47 can form, for instance, a compartment for a label.

To produce such document protecting devices, and in a manner known per se in this field, there is formed a continuous sleeve of flexible plastic or a similar material, which is folded down flat on itself to form the two opposite lateral sides of the quadrangular pocket, then it is cut, and the continuous sleeve is welded transversely to form respectively the first opening 3; 13; 23; 33; 43; 53, and the closed opposite fourth side 5; 15; 25; 35; 45; 55.

According to the invention, the sleeve is formed from a sheet folded back on itself and the free edges of which are partially welded to one another.

This technique has the advantage of being more suitable with regard to the choice of size, since one and the same sheet can be re-cut to any desired dimensions, unlike techniques, which are more often used according to previously known processes as they have the advantage of increased strength, particularly in the area of the lateral edges since it is not necessary to have recourse to welding.

The second opening 4; 14; 24 is formed implicitly, in the region of the free edges of the folded over sheet, by the non welded area.

Figure 2:
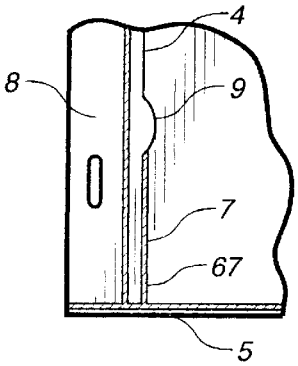
FIG. 2 is a detail view of a first variant of manufacture of the device according to FIG. 1.
Figure 5:
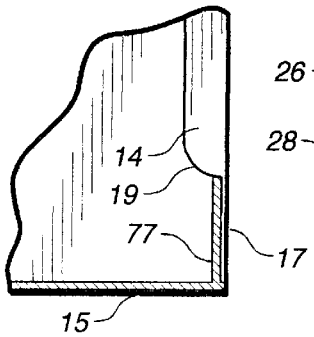
FIG. 5 is a detail view of the device according to FIG. 4.

In other words, in the course of manufacture, there will advantageously be provided a weld area 67; 77, as shown, for example, in FIGS. 2 and 5. As mentioned earlier, in order to reinforce the weak area formed by weld 67, 77, one can, for example, cut out a notch 9, 29; 39, 49 and/or provide a cut away portion 19 in one of the faces of the pocket 2; 12; 22; 32; 42 in the vicinity of the limit between the second opening 4; 14; 24; 34; 44 and the welded area 7, 17, 27, 37, 47.

Figure 3:
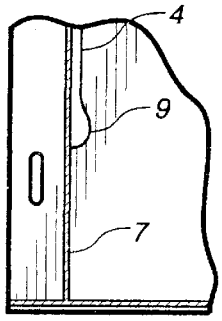
FIG. 3 is a detail view of a second variant of manufacture of the device according to FIG. 1.

As regards the form of embodiment of FIG. 1, it should be noted there can be provided a double weld, as illustrated in FIG. 2, or a simple weld, as illustrated in FIG. 3, which then jointly forms the means of maintaining the perforated strip and the non open area on the second opening side.

Figure 10B:
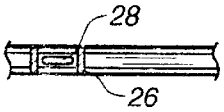

As shown in FIGS. 9 and 10, according to a particular form of embodiment of the invention, a weld is produced on either side of a strip 28 provided, in the region of one of the sides 26 of the pocket 22, between each of the faces of the said pocket 22 and the strip 28 and the pocket 22 are perforated.

It goes without saying that other embodiments of the present invention, within the grasp of a man of the art, could have been contemplated, without thereby departing from its scope.

I claim:

1. A document protecting device, formed by at least one quadrangular pocket for avoiding any undesired protrusion of the documents to be protected, said quadrangular pocket being made of a flexible plastic, said quadrangular pocket comprising a first opening on one side thereof, said quadrangular pocket further comprises a partial opening on a side adjacent to said first opening, said quadrangular pocket further comprising a slot means terminating said partial opening for preventing tearing of a non-open area on a side of a corresponding pocket, said slot means having a longitudinal shape.

2. The document protecting device according to claim 1, in which said first opening is uppermost and said partial opening is provided laterally on a right or on a left of the pocket.

3. The document protecting device according to claim 1, in which the pocket has laterally, in the region of one of its sides, a perforated strip means for binding the device to another such device.

4. The document protecting device according to claim 1, having a plurality of pockets gathered together on at least one lateral side.

5. The document protecting device according to claim 1 comprising means for complementarily retaining documents ahead of said non-open area substantially in prolongation of said partial opening.

6. The document protecting device according to claim 1, having a lateral compartment for a label.

7. A process for manufacturing a document protective device having at least one quadrangular pocket arranged so as to prevent undesired protrusion of the documents to be protected, the process comprising the steps of:

forming a continuous sleeve of a plastic material by folding a sheet back onto itself, said continuous sleeve forming two opposite lateral sides of the quadrangular pocket;

cutting and welding said continuous sleeve transversely to form an opening on one side and a closed opposite side;

partially welding together free edges of the folded sheet so as to form a welded area and a non-welded area, another opening being defined by the free edges at said non-welded area; and cutting out a slot in a face of the quadrangular pocket in a vicinity of an area between said another opening and said welded area, said slot being of longitudinal shape.

8. The process according to claim 7, further comprising the steps of:

producing a weld on a side of a strip in a region on one side of the quadrangular pocket, said weld being produced between faces of the quadrangular pocket; and perforating said strip and said quadrangular pocket.

* * * * *